United States Patent [19]

DiFrank et al.

[11] Patent Number: 4,832,774

[45] Date of Patent: May 23, 1989

[54] METHOD AND APPARATUS FOR APPLYING WRAP-AROUND LABELS TO CONTAINERS

[75] Inventors: Frank J. DiFrank; Richard H. Garnes, both Toledo, Ohio

[73] Assignee: Owens-Illinois Glass Container Inc., Toledo, Ohio

[21] Appl. No.: 190,979

[22] Filed: May 6, 1988

[51] Int. Cl.[4] ..... B65C 9/24

[52] U.S. Cl. ..... 156/215; 156/443; 156/458; 156/486; 156/489; 156/521; 156/566; 156/583.1; 156/DIG. 36

[58] Field of Search ..... 156/215, 443, 583.1, 156/DIG. 36, DIG. 13, 521, 566, 569, 86, 573, 571, 564, 447, 486, 489–491, 456–458

[56] References Cited

U.S. PATENT DOCUMENTS 3,222,240 12/1965 Carter et al. ..... 156/486 X 4,444,613 4/1984 Burmeister ..... 156/583.1 X 4,605,459 8/1986 Voltmer et al. ..... 156/215

*Primary Examiner*—Michael W. Ball

*Assistant Examiner*—Jeff H. Aftergut

[57] ABSTRACT

Apparatus and method of applying wrap-around labels to bottles or containers where the label is formed into a complete sleeve with a heat-sealed seam on the container as the containers are moved in a linear path on a conveyor. The bottles and conveyor pass between a continuously moving set of retractable, electrical heat-seal bars and vacuum label handling heads. The vacuum heads receive individual labels from a strip supply of labels and carry the labels into position opposite a bottle on the conveyor. The label is folded about the bottle and the opposed heat-seal bar is advanced into contact with the overlapped edges of the label and held there for a time sufficient to complete the full height heat seal of the label. The heat bar is contoured to the same shape as the external profile of the container over the label height.

15 Claims, 11 Drawing Sheets

METHOD AND APPARATUS FOR APPLYING WRAP-AROUND LABELS TO CONTAINERS

BACKGROUND OF THE INVENTION

It has become generally accepted in the trade that containers which contain beverage and food products will have a label thereon. Many different systems are presently used to apply the labels to the containers. Some of these systems will apply the label to the container after it has been filled and sealed. Other systems utilize the prelabeled container which is then filled with the product and sealed before distribution.

The present invention is most closely associated with the systems that prelabel the containers before they are filled with a product.

Prior art systems which prelabel containers are known, and one such system which has received considerable acceptance is that disclosed in U.S. Pat. No. 3,802,942, issued to Amberg et al and assigned to the Assignee of the present application. This patent teaches the forming of labels from heat shrinkable plastic that is formed of a film-foam combination plastic that is fed in an oriented sheet form to a vacuum transfer head. The labels are preprinted and cut into lengths as they are received on the transfer head which then delivers the individual labels to a plural mandrel turret apparatus which winds the label into a complete sleeve on a mandrel and forms a seam where the ends overlap. Containers are simultaneously processed by being preheated and indexed over the sleeve supporting mandrels. The sleeves are telescopically assembled on the containers and then, together, are transported through a heat shrink tunnel. The plastic sleeve shrinks into snug surface fit with respect to the container.

As can be seen by reading the foregoing U.S. patent and U.S. Pat. No. 3,767,496, issued Oct. 23, 1973, which discloses the overall process that the apparatus of U.S. Pat. No. 3,802,942 will perform, the forming of a tightly conforming, heat shrunk label on a container, such as a glass bottle, is not a simple task. To prevent wrinkling of the label and consequent distortion in the graphics of the label, it is necessary to apply the label to the bottle in a careful manner. The ends of the label must come into registry so that the label will not seem to be askew. When the label is to be a heat-shrinkable plastic, the ends have to overlap and be firmly sealed together to form a seam that will withstand the stress that is produced when the label shrinks.

When it seemed desirable to make the labeled container without having the label formed into a seamed sleeve before applying it to the container, systems were designed to use the bottle or container itself as the mandrel and then wind the label about the bottle and seal the overlapped ends. This system has been disclosed in several recent U.S. Pat. No. 4,574,020, issued Mar. 4, 1986, to H. R. Fosnaught and assigned to the assignee of the present case.

In this patent there is disclosed apparatus and method for a high speed production line in which a container is wrapped with a film-foam plastic label comprising a foam polystyrene layer, there being a system for moving the leading edge of the label to the periphery of a rotating vacuum drum, means to apply a solvent to the underside of the foam layer to form finite areas, on the leading and trailing edges of the label, of a tacky solution. The solvent applied label is rapidly moved by the vacuum drum to a label-wrapping station where it is wrapped about the container with the finite areas of the solvent on the leading edge adhering to the container and the trailing edge overlapping and becoming sealed to the leading edge to form a complete vertical seam. After application of the label, the container is moved through a heat-applying oven to heat shrink the label into conformity with the underlying container.

The foregoing system, which utilizes a solvent to form the adhesive, has also been modified as taught in U.S. Pat. No. 4,662,965, issued May 5, 1987, to use a "hot melt" adhesive in place of the solvent to tack the leading edge of the label to a container and to firmly adhere the trailing edge to the leading edge to form a complete cylindrical sleeve that is then passed through the heat shrink oven.

The foregoing systems have proven useful; however, the solvent systems have presented problems in the plants where the solvent is being used because of the inherent nature of the vapors being present in the area surrounding the label-applicating machine. Exhaust systems are used to clear the atmosphere but these are costly to install and maintain. Also, the solvents are fairly expensive and in operation over a full day, a considerable quantity will be consumed. With the foregoing in view, the present invention is one which will overcome the problems found in the prior art systems.

SUMMARY OF THE INVENTION

It is an object of the present invention to provide a labeling system for cylindrical objects, such as containers, where the individual labels are severed from a continuous web of labels and transported in series to a line of containers also moving in series along a linear path. The labels are mechanically held adjacent the containers and have their ends moved about the containers into overlapping relationship, at which time the overlap is heat sealed, all while the containers and labels are following a generally linear path during assembly and sealing of the labels.

It is a further object of the invention to provide a system for applying individual wrap-around plastic labels to containers, where the containers are not required to be rotated about their axes, but only move on the surface of a moving conveyor.

It is a still further object of the invention to provide a system for handling individually cut labels so as to move the labels, in series, into alignment with the line of moving containers and to hold the center of the labels while moving the ends outwardly into surrounding relationship with a container and to overlap the ends of the label where a heat-seal bar will engage the "overlap" and remain in contact with the overlap for a time sufficient to form a complete vertical heat seal.

It is a still further object of this invention to seal the overlapping ends of a heat-sealable plastic label that held about the circumference of the container sidewall, shoulder and heel with an electrically heated bar that has a contour which matches the container sidewall, heel and shoulder so that contact of the bar against the label will assure a full height seal of the label ends so that subsequent heat shrinkage of the label will result in the label closely surrounding the container or bottle shape without a mismatch of the label ends or failure of the vertical heat-sealed seam.

Other and further objects will be apparent from the following detailed description taken in conjunction with the annexed sheets of drawings.

DETAILED DESCRIPTION OF THE PREFERRED EMBODIMENT

Figure 1:
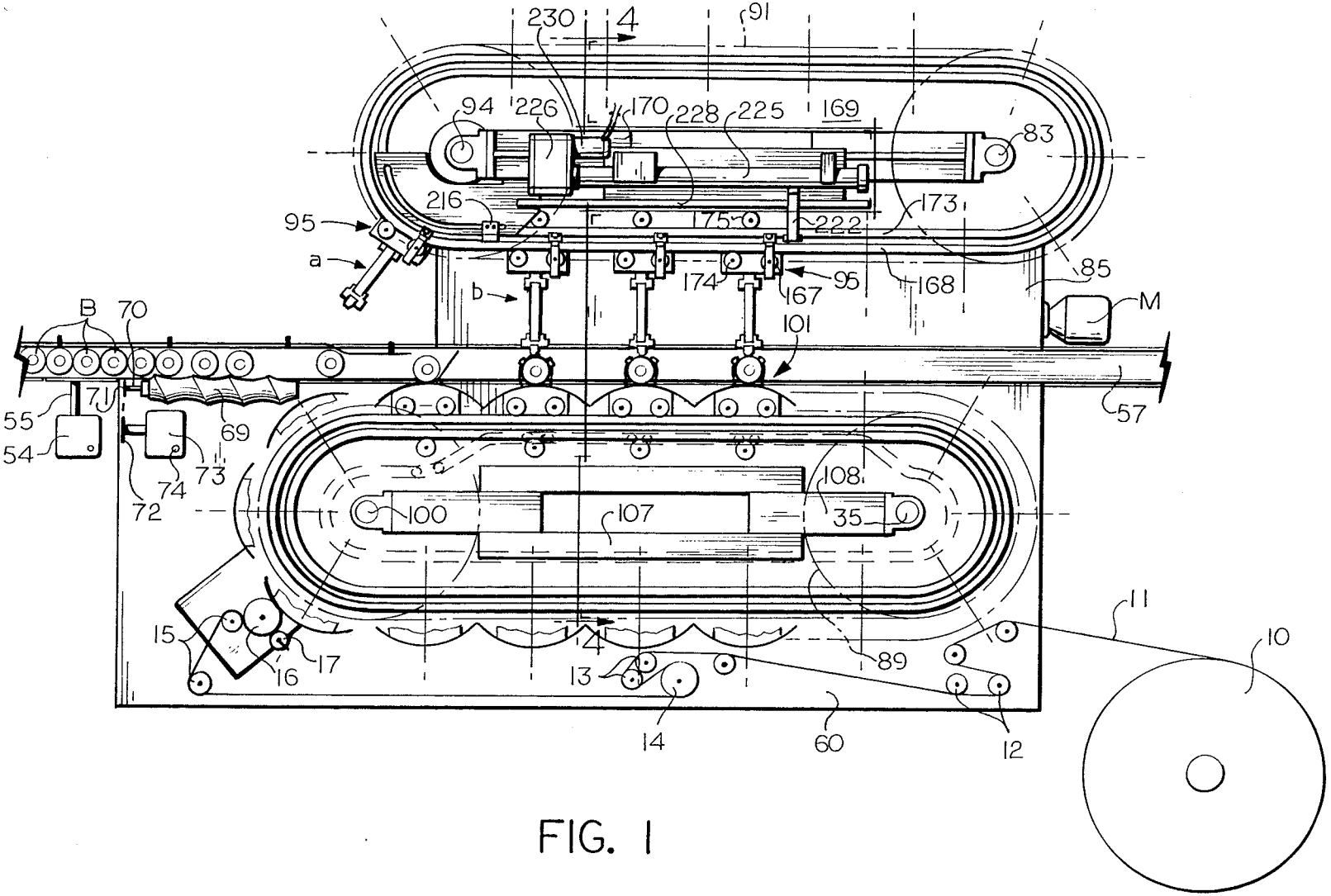
FIG. 1 is a plan view of the label applying machine of the invention.
Figure 3:
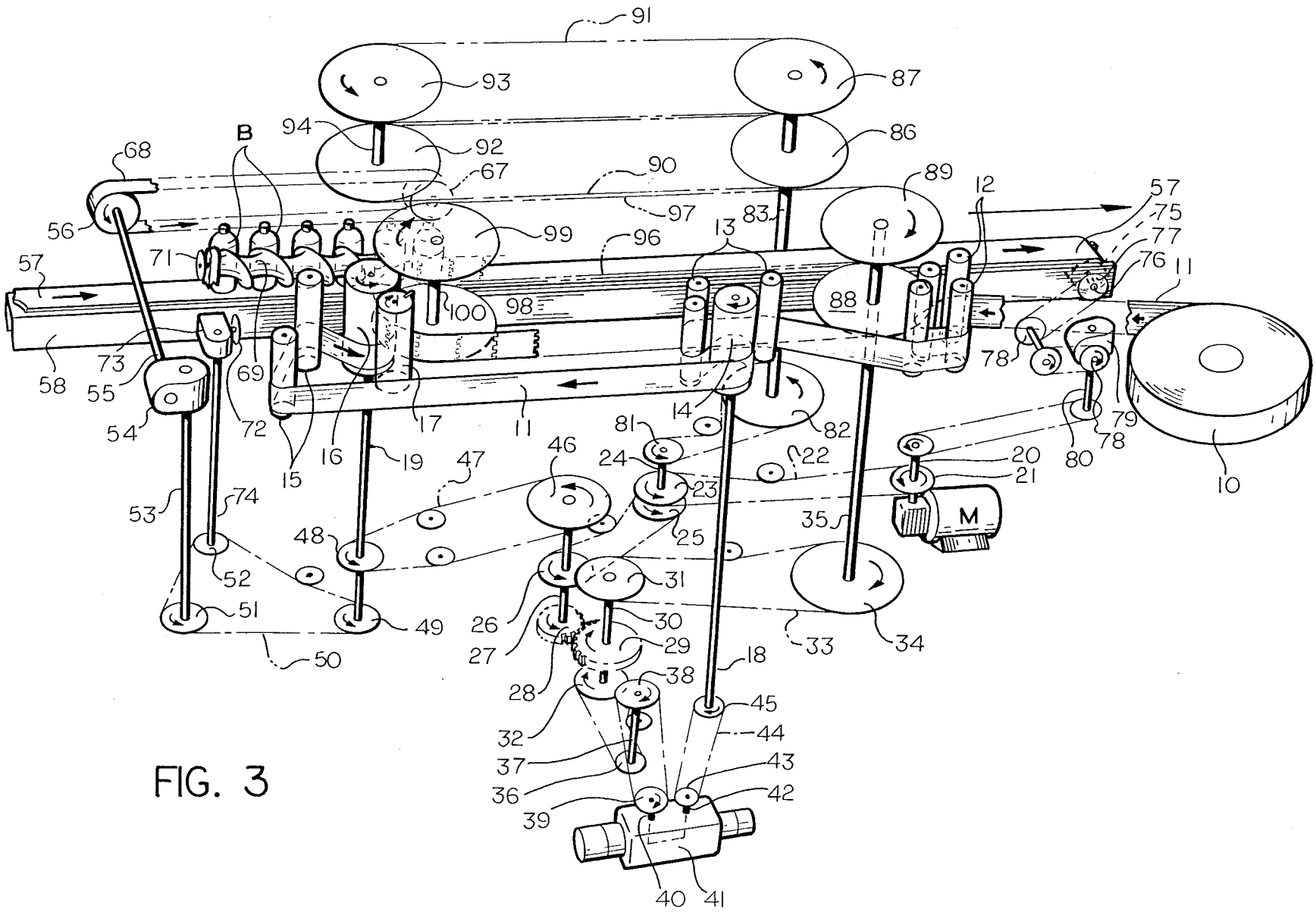
FIG. 3 is a schematic perspective view of the label handling and bottle conveying system of FIG. 1.

The present invention relates to the forming of thermoplastic sleeve labels about the circumference of containers, such as glass bottles, where the labels come in a strip and are severed into label lengths before being applied to the bottle. As best shown in FIGS. 1 and 3, the labels come in a large roll 10 which is supported (not shown) for rotation about a vertical axis. The strip 11 of label material is threaded about a set of guide rollers 12. Another set of guide rollers 13 receive the strip or web of labels and serve to guide the strip about a first drive roll 14. An additional pair of idler rolls 15 serve to guide the web into contact with a vertical roll 16 which serves to transport the loading end of the label strip past a rotating knife 17 that will cut the strip at the precise length of the individual label.

The drive roll 14 is driven by a vertical shaft 18 and the roll 16 is driven by a shaft 19. As can best be seen in FIG. 3, the schematic view of the drive system for the entire machine, a motor M serves as the power source for all of the rotating mechanisms on the machine. The motor M has an output shaft 20 which drives a sprocket 21 which is connected by chain 22 to a sprocket 23 carried on a shaft 24. The shaft 24 carries a second sprocket 25 which is drivingly connected to a sprocket 26 carried by a shaft 27. The shaft 27 drives a spur gear 28 which is in mesh with a spur gear 29 mounted on a shaft 30. The shaft 30 has a pair of sprockets 31 and 32 mounted thereon with the sprocket 31 driving a chain 33 that drives a sprocket 34 mounted on a shaft 35. The sprocket 32 drives a sprocket 36 on a shaft 37 that also carries a sprocket 38. The sprocket 38 drives a sprocket 39 on the input shaft 40 of a variable ratio drive 41. The drive 41 has an output shaft 42 carrying a drive sprocket 43. The drive sprocket 43 is connected by a chain 44 to a sprocket 45 mounted to the shaft 18 for driving the drum 14.

In addition to the sprocket 26, the shaft 27 carries a sprocket 46 which, through a drive chain 47, drives a sprocket 48 on the drive shaft 19 carrying the drum 16.

The shaft 19 also carries a sprocket 49 which drives a chain 50 that is in driving engagement with a pair of sprockets 51 and 52. The sprocket 51 drives an input shaft 53 for a gear box 54 whose output shaft 55 drives a pulley 56 mounted in overlying relationship to an infeed conveyor 57. The conveyor 57 is supported for horizontal movement by an inverted "U" channel 58. A vertical mounting plate 59 is supported from the side of the channel 58 which in turn is supported above a generally horizontal table 60 supported from the floor by vertical legs 61. The rotating shafts, such as 24, 27 and 30, extend from the bottom of the table 60 and are supported by a horizontal platform 62 which is below and generally parallel to the table 60, as shown in FIG. 2.

The pulley 56 is supported at the left end of a horizontal beam 63 that is adjustably mounted to the plate 59 by a threaded adjusting screw 64 which is threaded through a boss 65 on the plate 59 and thrust bearing 66 carried by the beam 63. The beam 63 at its right end, as viewed in FIG. 2, supports a pulley 67. An endless belt 68 extends about the pulleys 56 and 67 and presents a generally horizontal run between the pulleys. The lower surface of the belt 68 adapted to engage the top of bottles "B" that are positioned on the conveyor 57 and to keep the bottoms of the bottles in contact with the conveyor surface during their entry into the labeling machanism.

Figure 2:
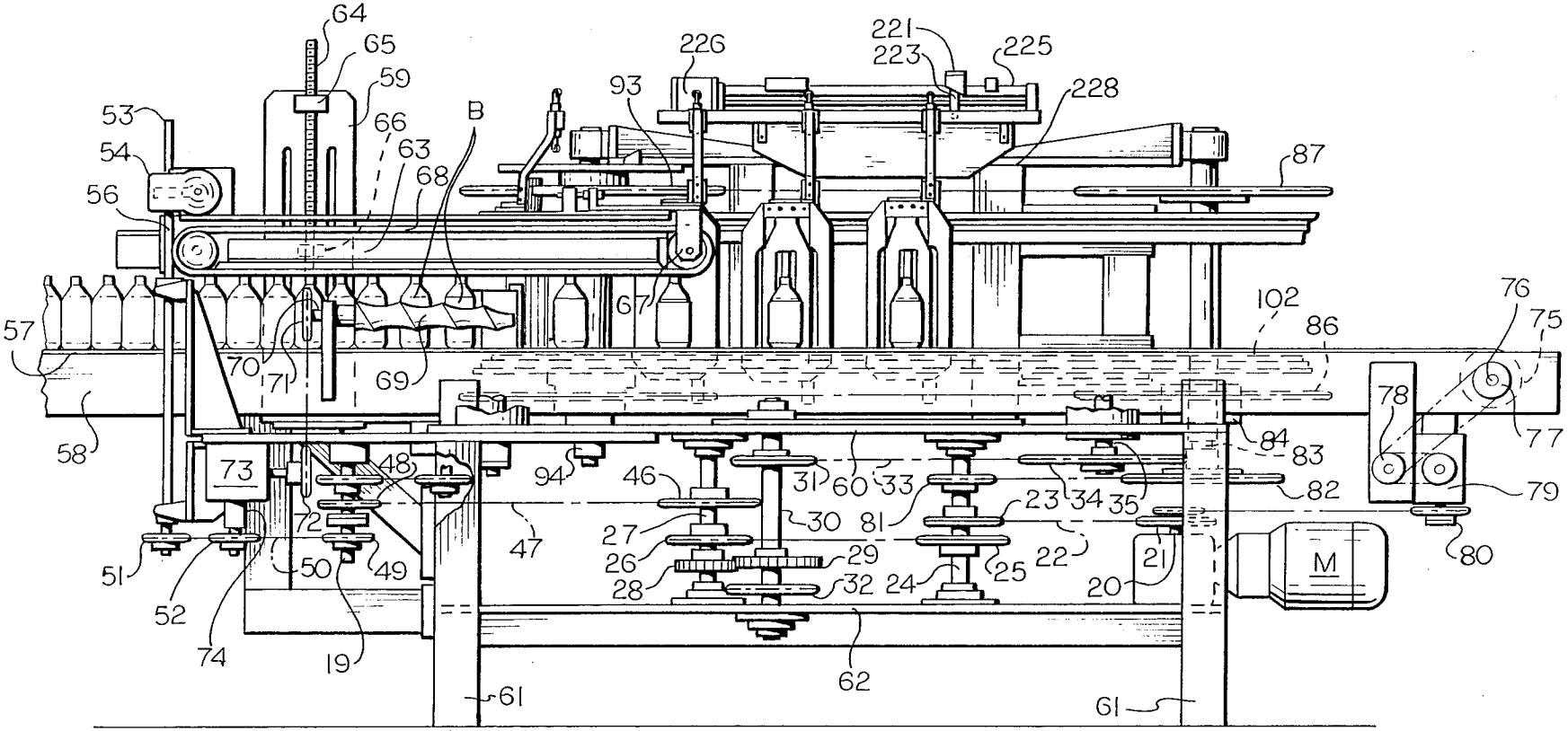
FIG. 2 is a schematic, side elevational view of FIG. 1, taken with the mechanism above the conveyor removed on the near side.

The bottles "B" that are fed to the system from the left, as viewed in FIGS. 1-3, are moved by the conveyor 57 into engagement with a infeed worm 69 mounted for rotation about a horizontal axis 70 and driven by a sprocket wheel 71 that is driven by chain from a sprocket 72 connected to the output shaft of a gear box 73 which is driven by a shaft 74 that has the sprocket 52 mounted thereon.

As shown in FIGS. 2 and 3, the conveyor is driven from the right end by a drive pulley or sprocket 75 through the shaft 76 that carries a sprocket 77. The sprocket 77 is chain driven by a sprocket 78 that is driven by the output shaft of a gear box 79. The gear box 79 has an input shaft 80 that is connected by sprocket and chain drive to the output shaft 20 of the motor M. Thus it can be seen that the main bottle conveyor 57 is driven in the direction of the arrow thereon by the same power source that is used to drive the label handling and drive system 14, 16. Therefore, the movements are all controllable by the speed of the motor and the settings of the various gear boxes throughout the system. Obviously, several individual motors could be used; however, they would all have to be in synchronism under control of a single timing motor in order to effect a system where all the elements that are being driven will operate at the correct time.

In addition to driving the conveyor, the motor M drives a sprocket 81 mounted on the shaft 24 with the sprocket 81 driving a drive sprocket 82 mounted to a vertical drive shaft 83. The drive shaft 83 extends through a bearing 84 mounted to a table 85 which extends to the left of table 60 (as viewed in FIG. 4) and overlaps the surface thereof to some extent. The shaft 83 supports a pair of vertically spaced, large diameter sprockets 86 and 87. In a like manner the shaft 35, which extends through the table 60, supports a pair of vertically spaced sprockets 88 and 89.

As schematically illustrated in FIG. 3, the sprockets 86 and 87 drive chains 90 and 91 which extend in an elongated, horizontal path about idler sprockets 92 and 93 mounted on a vertical axle or shaft 94. As explained later in conjunction with FIGS. 4 and 9–11, the chains 90 and 91 have sealing bar carriages, generally designated 95, connected thereto and movement of the chains will move the plurality of carriages 95 in an endless path about the shafts 83 and 94. In a like manner, the sprockets 88 and 89 drive endless chains 96 and 97 which are in engagement with idler sprockets 98 and 99 mounted on a vertical shaft 100 at corresponding heights to the drive sprockets 88 and 89. The chains 96 and 97 have vacuum pad carriages, generally designated 101, connected thereto and serve to drive the plurality of carriages 101 in an elongated path about the drive and idler sprockets. The carriages 101 will be described in greater detail in conjunction with FIGS. 4–8 which illustrate these carriages 101 and the manner in which they handle the individual labels.

With reference to FIGS. 4–8, the vacuum carriages 101 are supported by a pair of horizontal plates 102 and 103 that extend between and beyond both shafts 35 and 100. The lower plate 102 is supported above the table 60 by a pair of hollow frame members 104 that held the plate above the table. The members 104 are joined adjacent their ends into a single frame 105 that serves as the anchor for bearing blocks for the shaft 35. The upper plate 103 is supported by a vertical pedestal 106 (FIGS. 2 and 4) and a pair of hollow frame members 107 which are joined by a single frame member 108 which supports the upper bearing block for the shaft 35 at one end, and the shaft 100 at the opposite end. The frame members are hollow in the interest of providing strength without weight.

The plate 103 has an endless dual rail guide track 109 mounted thereon. The track 109 is actually made up of a pair of parallel rails **109*a* that have a beveled edge which serves to provide a track for a pair of beveled edge wheels 110 and 111 at the front of the carriage at the top and a single wheel 112 at the back of the carriage. Thus the wheels engage both the front and back of the guide track 109. The wheels 110 and 111 are mounted for rotation about vertical axles carried in a member 113 which in turn is carried at the upper end of a vertical frame 114**.

Figure 6:
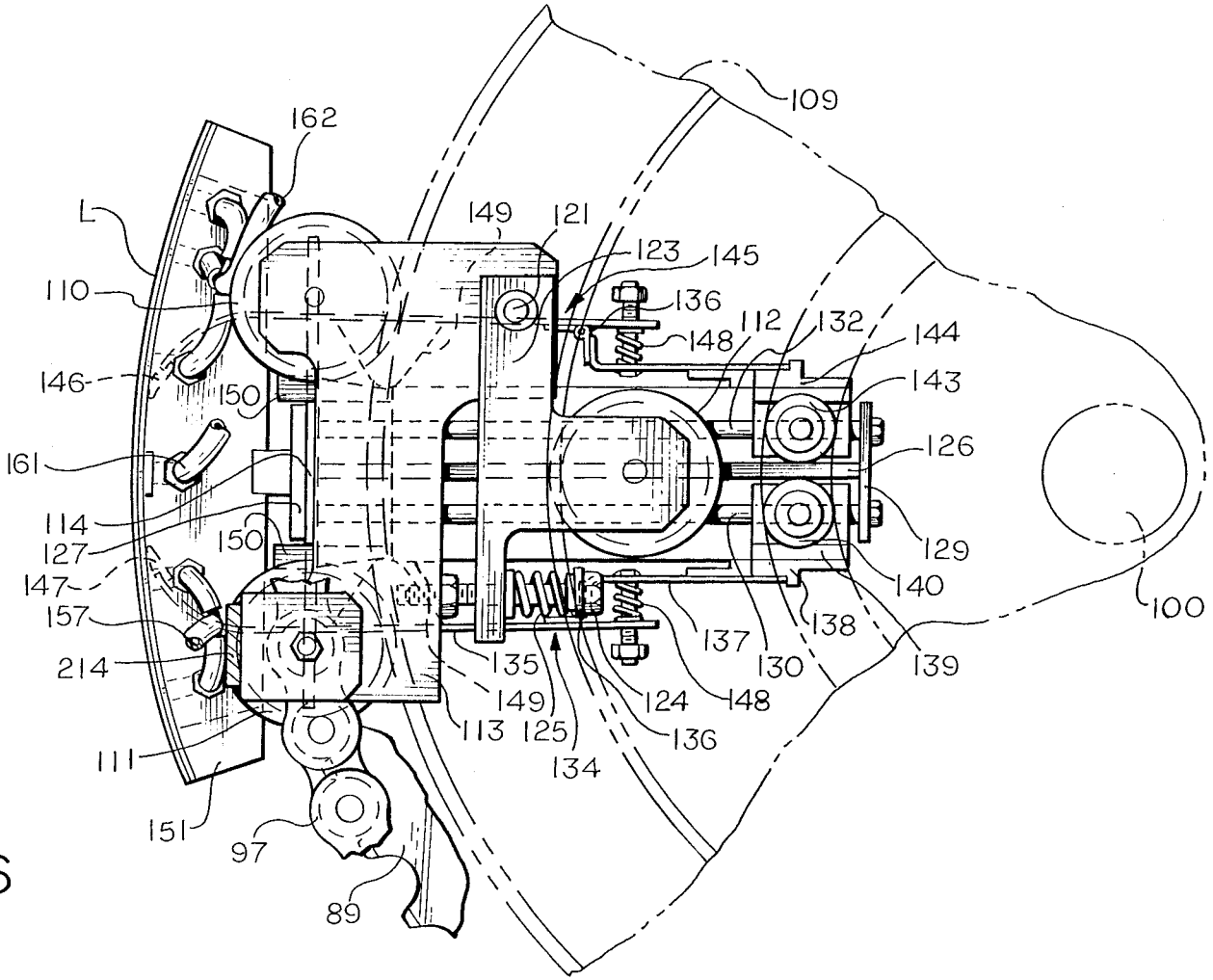
FIG. 6 is a plan view of the label transport head of FIG. 5 on an enlarged scale.

At the lower end of the frame 114, there are a pair of beveled edge wheels 115 mounted on a horizontal support member 116. The member 116 carries a downwardly extending boss 117 which is attached to the power drive chain 96. The lower horizontal plate 102, in a manner similar to the plate 103, carries an endless guide track 118 fixed to its under surface. The guide track is made up of a pair of spaced, bevel edged rails 119 which engage the pair of beveled wheels 115 and a single wheel 120. The single wheels 120 and 112 are actually mounted on separate support members 122 and 123 that are pivotally mounted by pivot pins 121 to their respective support members 116 and 113. A threaded bolt 124 (as illustrated in FIG. 6) extends through an opening in the member 123 and threads into the member 113 for adjustment purposes, with a spiral spring 125 positioned between the head of the bolt 124 and the support member 123. In this manner the single wheel 112 is biased in the direction of the guide rail **109*a* and the pair of wheels 110, 111. (See FIGS. 6–8**.)

The vertical frame 114 that supports the wheels 110, 111, 112, 115 and 120 supports a vertical web 126 that extends at right angles to the frame 114. In effect, the web 126 extends away from the frame 114 in the vertical gap between the plates 102 and 103. The forward edge of the web 126 is fixed to the back of a vertical plate 127 which is positioned in an opening 128 of the frame 114 of the vacuum pad carriages 101. Opposite its connection to the plate 127, the web 126 supports a vertical plate 129. On one side of the web 126 are positioned a pair of vertically spaced, horizontal guide rods 130, 131 with a similar pair of horizontal rods 132 and 133 mounted on the opposite side of the web 126. The rods 130-133 extend between the plates 127 and 129 and are fixed thereto. The rods 130 and 131 form a horizontal guide for a label, trailing edge, push finger 134. The finger 134 is in the form of an elongated, horizontal steel member 135 which is fastened at its one end to one side of a hinge 136. The hinge 136 has its other side fixed to a plate 137 which in turn is fixed to a bushing 138 of a vertical arm 139. The arm 139 is mounted by its bushing 138 for horizontal movement on the lower guide rod 131. The arm 139 also has an opening through which the uppwer guide rod 130 extends. The arm 139 has a cam-follower roller 140 connected to its upper end with the roller extending into a cam track 141 of a horizontal cam plate 42. The cam plate 142 is fixed to the underside of the plate 103. The full cam track 141 is schematically illustrated in FIG. 1 and forms an endless track within which the roller 140 and a second roller 143 are positioned. The roller 143 is connected to the upper end of an arm 144 which is a mirror image of the arm 139. The arm 144 is on the other side of the web 126 and supports a push finger 145. The finger 145 has an outer end 146 which is curved, in a vertical plane, toward the web 126 as does the outer end 147 of the finger 134. The fingers 145 and 134 are mounted to hinge about the hinges 136 but are spring biased by springs 148 in the direction of the web 126. Each finger carries a V-shaped cam block 149 which cooperates with beveled cams 150 that are fixed to the stationary plate 127 at opposite sides thereof to be in position to be engaged by the cam blocks 149 during the reciprocating movement of the fingers as they are driven by the cam rollers 140 and 143.

Figure 7:
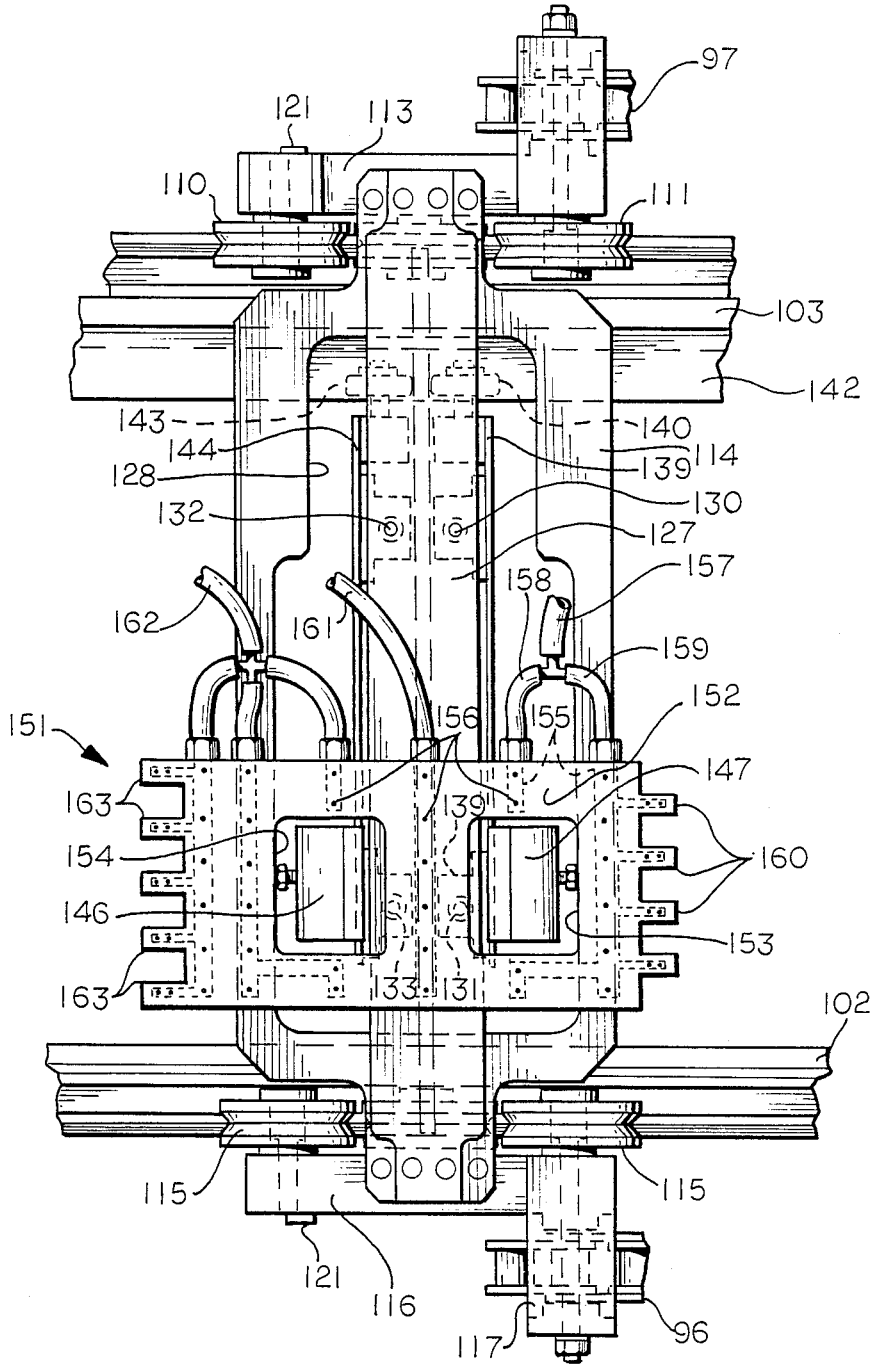
FIG. 7 is a front elevational view of the label transport head of FIG. 6 on a reduced scale.
Figure 8:
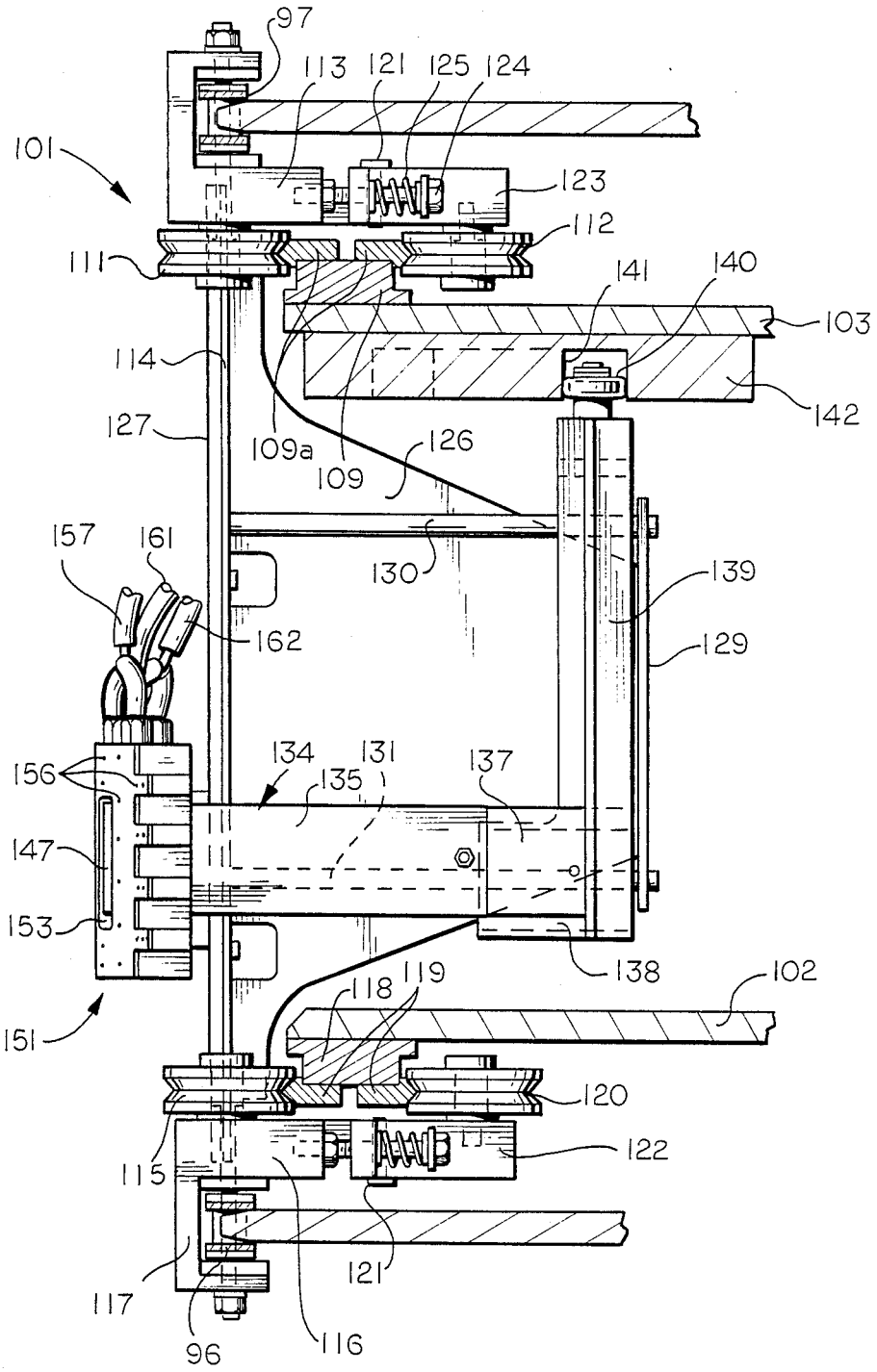
FIG. 8 is a side elevational view of the label transport head of FIG. 7.
Figure 9:
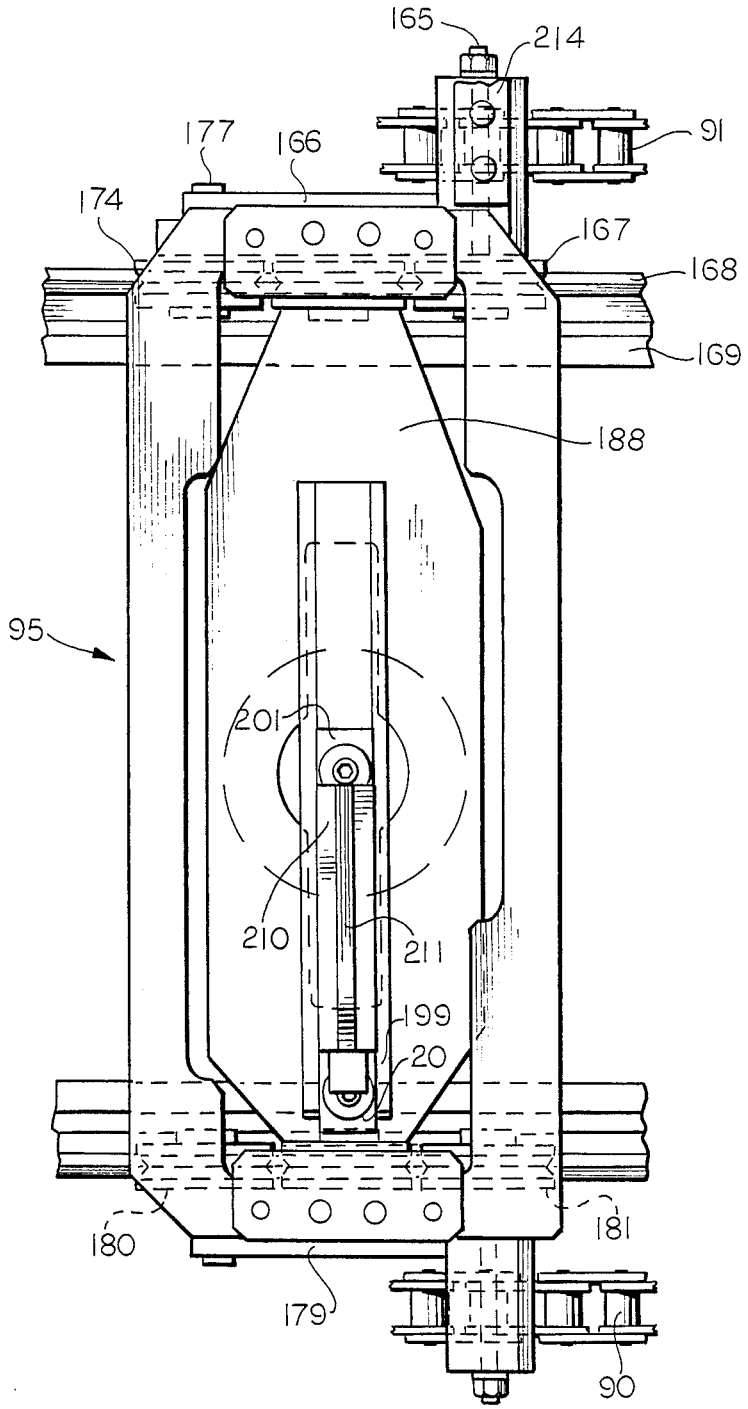
FIG. 9 is a front view of the heat-seal bar and mounting mechanism taken at line 9—9 of FIG. 4 on an enlarged scale.

Fixed to the outer face of the vertical plate 127 is an aluminum casting 151 which is formed with an arcuate face 152. The casting 151 is formed with a pair of generally rectangular openings 153 and 154 that extend therethrough. The outer end 147 of push finger 134, when in the retracted position as shown in FIGS. 6 and 8, is positioned within the opening 153 in the casting 151. The casting 151 is provided with several vertical passages 155 which serve as manifold passages connected to a plurality of vacuum ports 156 that extend through the arcuate face 152 thereof. As best illustrated in FIG. 7, the face 152 of the casting 151 is provided with a plurality of vacuum ports which, for functional purposes, are separated into three sets. The set at the right, as viewed in FIG. 7, is connected to a vacuum line 157 by branch lines 158 and 159 which communicate with two vertical manifolds 155. The manifold passage at the extreme right has several branch passages that extend into fingers 160 of the casting. All of the ports at the right will receive vacuum when line 157 is connected to a vacuum source (not shown). A central, vertical manifold is connected to a vacuum line 161. Three vertical manifold passages, at the left in FIG. 7, are connected together to a vacuum line 162. The extreme left hand manifold 155 has branch passages which extend through fingers 163. It should be noted that the fingers 160 of an adjacent casting will extend between the fingers 163 of the next casting. As viewed in FIGS. 1 and 5, the plurality of castings 151 are presented to the label bearing transfer roll 16, such that the leading edge represented by the fingers 163 will first engage the surface of the label. The vacuum through line 162 will be connected to the vertical manifolds at the left resulting in the label adhering to the surface of the casting. As the casting 151 of FIG. 5 continues to be moved in the direction of the arrow, the label will be transferred to the arcuate surface of the casting and the knife 17 will sever the label at the proper time to give a label of predetermined length corresponding to the length of the arcuate surface 152 of the casting 151.

It can be seen that the label will be adhered or held by the vacuum ports to the surface 152. The individual labels will be transported by the castings from the vertical, transfer roll 16 to a position where the label will be applied about the circumference of a container on the conveyor 57 by the manipulation of the fingers 134 and 145. As can best be seen in FIG. 5, the label carrying castings 151 will move in a clockwise direction about the axis of shaft 100 being moved by the sprockets 88 and 89 and chains 96 and 97. The vertical arms 139 and 144 will move with the web 126, plate 129 and the casting 151, all of which are mounted to the vertical plate 129. The arms 139 and 144 have their operating rollers 140 and 143 positioned in the cam track 141. As the casting 151 is moved about the center of the shaft 100, the rollers 140 and 143 follow the circular path of the cam track. The cam track 141 departs from this circular path at the location 164 where the roller 143 follows the outward divergent path of the track. This movement, in effect, moves the push finger 145 toward the bottle that has been timed on the conveyor by the worm 69.

It should be remembered that the bottle is being held down against the conveyor surface and therefore is effectively being held in a stable, upright position while moving with the conveyor. The stabilized bottle will have its central axis in alignment with the central manifold passage in the casting 151. The vacuum to the line 162 is cut off just as the roller 143 starts past the location 164 and begins to move the finger toward the bottle. When this occurs the end 146 of the finger 145 will move out of the opening 154 in the casting and push the label outwardly. The finger will engage the label and be cammed out to the right as viewed in FIG. 5 to, in effect, move the leading edge of the label around the leading side of the bottle.

Figure 5:
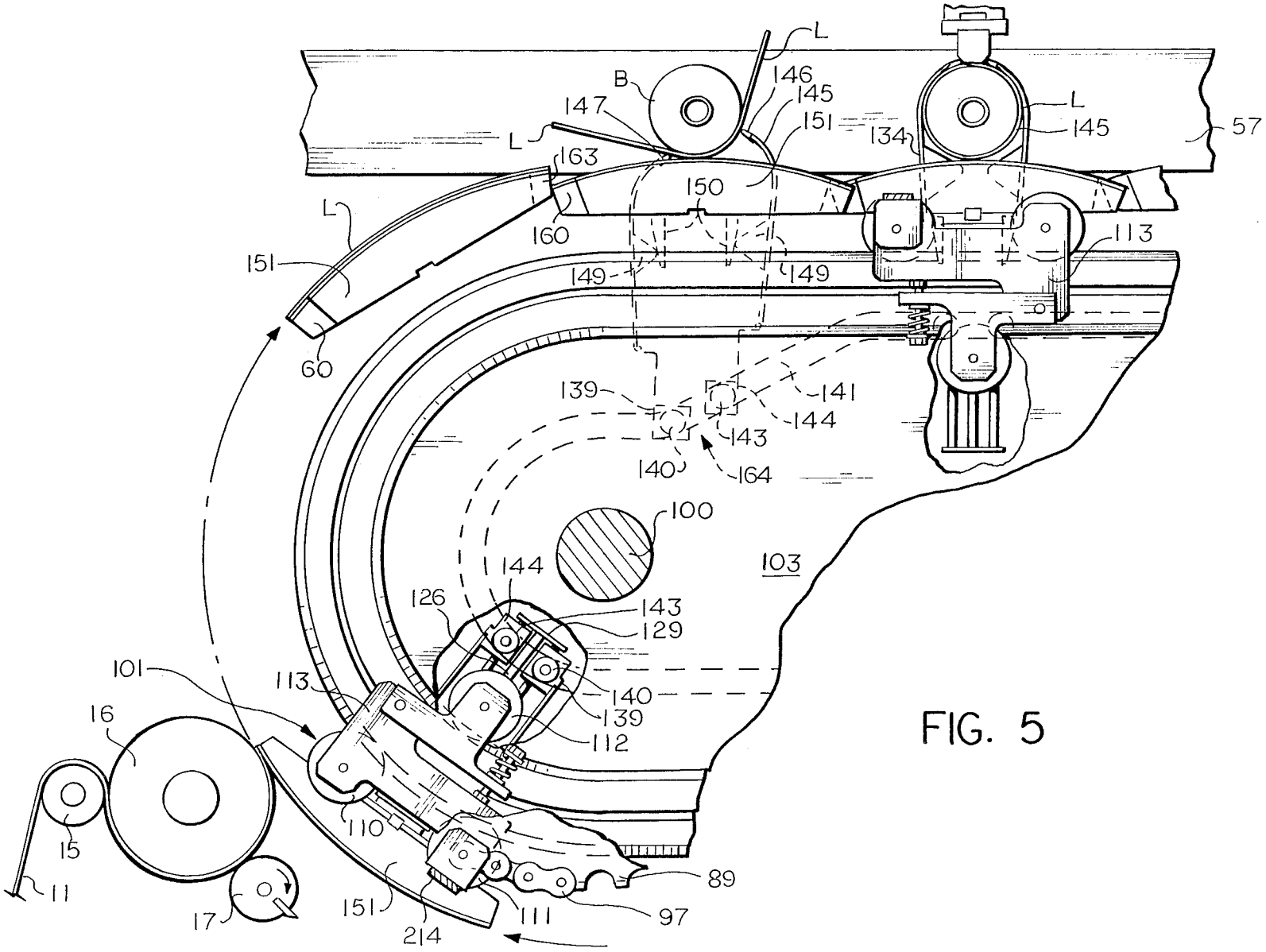
FIG. 5 is a plan view on an enlarged scale of the label pickup transport and assembly mechanism of FIG. 1 illustrating the assembly of the label about a container.

This is schematically illustrated in FIG. 5 by the dotted line positions of the roller 143 and arm 145. The end 146 of the finger 145 will actually move along the contour of the bottle under the influence of the cam 150 and block 149. Also, the arm 145 is spring-biased in the direction of the bottle and may give as necessary.

While the arm 145 is moving the leading edge of the label about the leading side of the bottle, the vacuum in the central manifold is maintained so that the label will remain in its vertical and horizontal position.

The trailing edge of the label is engaged by the end 147 of finger 134 and the vacuum in the line 157 is cut off as the trailing edge of the label pushes outwardly by the finger 134 under the control of the roller 140. It can be seen that the rollers 140 and 141 will move the fingers 134 and 145 outwardly at slightly different times. This is important since it is important that the ends of the label must overlap so that they can be sealed together to form a complete sleeve about the bottle. By having the leading end or edge of the label moved about the container first, this edge will be in position for the trailing end or edge of the label to overlap it.

When the rollers 140, 143 have moved the fingers out as far as they are able under the control of the cam track 141, the fingers will be essentially in the position shown at the top right in FIG. 5 with the label ends overlapped preparatory to be heat sealed together. Clearly, the arm 145 completes its forward motion before the arm 134.

Thus, from the foregoing description, it can be seen how the bottles are brought from the left in FIG. 1 and are timed by the worm 69 to be released to the moving conveyor in a predetermined sequence. The label material is fed to a position where the material is transferred to a vacuum transfer head as it is cut into a label length. The transfer head carries the label to a position opposite a bottle on the conveyor and the label is folded around the bottle and held with its free ends in overlapping relationship preparatory to being heat sealed to form a sleeve about the bottle.

As previously described, a plurality of sealing bar carriages 95 are moved into opposing relationship to the bottles on the conveyor 57 and the plurality of vacuum pad carriages 101. As explained in detail, the vacuum pad carriages 101 support the plurality of aluminum castings 151 with the arcuate label supporting faces 152.

Turning now to FIGS. 4, 9, 10 and 11, the details of the sealing bar carriages 95 will be described. All of the carriages are identical in construction and are connected to the driving chains 90 and 91 in essentially the same fashion as the vacuum pad carriages 101 are connected to their drive chains. A vertical shaft 165 connects one link of the upper chain 91 to a horizontal bar 166. The shaft 165 also supports a wheel 167, which is positioned below the bar 166, and is rotatable about the axis of the shaft 165. The wheel has an edge in the form of a V-shaped groove that engages a bevel edged rail 168. The rail 168 is mounted on the upper surface of horizontal plate 169 supported by an upper frame member 170. A lower horizontal frame member 171 supports the upper frame member 100 through a vertical member 172 and the lower frame 171 is supported by the table 85.

Extending parallel to the rail 168 is a rail 173. The rails 168 and 173 constitute a guide rail for the wheel 167 and additional wheels 174 and 175. The wheel 174 is pivotally mounted on the bar 166 and is in engagement with the rail 168 as is the wheel 167. The wheel 175 is pivotally mounted to an arm 176. The arm 176 is pivoted to the bar 166 at 177 and is biased by a spring 178 in the direction of the bar 166 with the effect of maintaining the wheel 175 in engagement with the rail 173.

The lower chain 90 is connected to a bar 179 at the lower end of the carriage 95. The bar 179 supports a pair of wheels 180 and 181 and also pivotally supports an arm 182 that is biased in the direction of the bar 179 by a spring 183 in the same manner as the arm 176 is biased by the spring 178. The arm 182 has a wheel 184 mounted thereon. The wheels 180 and 181 are in engagement with a rail 185 and the wheel 184 is held in engagement with a rail 186. The rails 185 and 186, which are substantially identical to the rails 168 and 173, are mounted to the underside of a horizontal plate 187 which extends generally parallel to the upper plate 169.

Extending vertically between the upper bar 166 and the lower bar 179 is a mounting plate 188. The plate 188 is welded to a pair of spacers 189 which in turn are welded to a mounting plate 190 for an air motor 191. The motor 191 has a reciprocating piston rod 192 which is connected by a pin 193 to a horizontally movable slide 194. The slide is a generally rectangular plate, laying in a vertical plane. Upper and lower edges 195 and 196 of the plate or slide 194 are formed with "V"-shaped edges which engage pairs of "V" edge rollers 197 that are mounted for rotation on axels that are carried on one side of a vertical portion 198 that forms part of the mount for the motor. The vertical portion 198 actually is a plate that extends to the left from the plate 190, as viewed in FIGS. 10 and 11. Operation of the motor 191 will move the slide 194 to the position shown in FIG. 11. The forward edge of the slide 194 has a vertically positioned slotted bar 199 fixed thereto. The bar 199 supports a horizontally extending arm 200. The arm is clamped in the vertical slot in the bar 199 by a pair of bolted clamp members 201 at the top and bottom.

Figure 4:
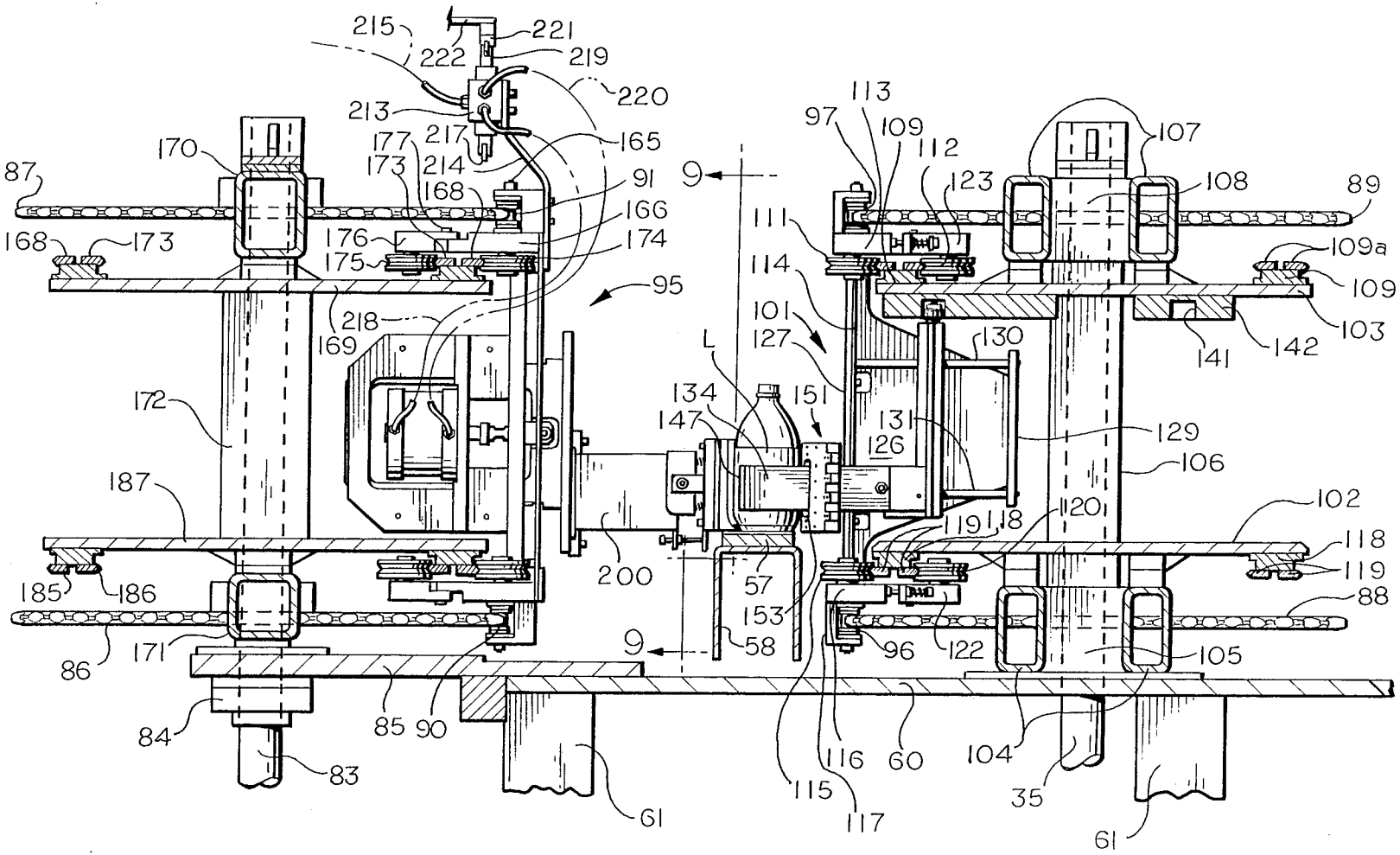
FIG. 4 is a cross-sectional view, on an enlarged scale, taken at line 4—4 of FIG. 1.
Figure 10:
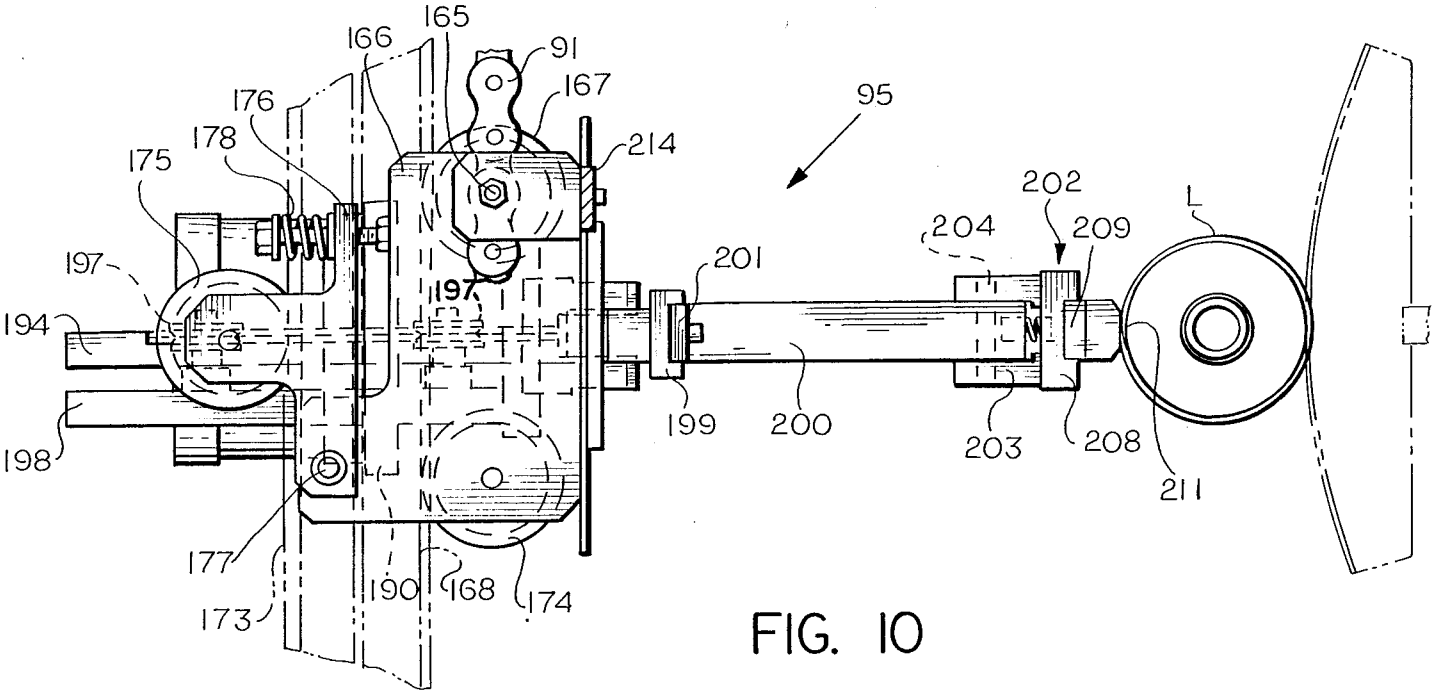
FIG. 10 is a top plan view of the seal bar mounting mechanism of FIG. 9.
Figures 11, 12:
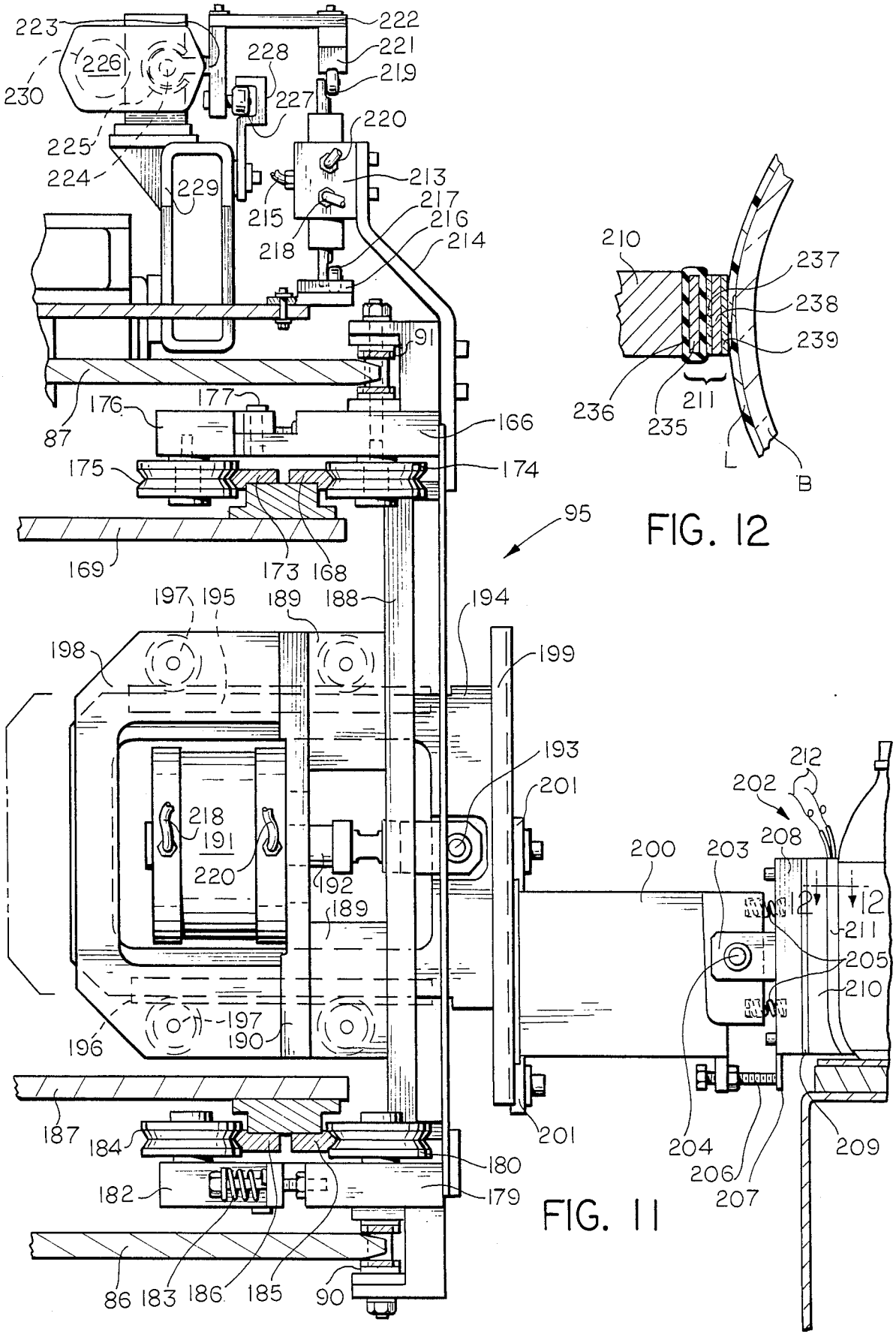
FIG. 11 is a side view of the mechanism of FIG. 10.
FIG. 12 is a cross-section taken at 12—12 of FIG. 11.

The arm 200 extends to the right, as viewed in FIGS. 4, 10 and 11, and supports a sealing head 002 at its end. The head 202 is fixed to a yoke 203 that is mounted on a horizontal pivot pin 204 so that the head 202 may move about the axis of the pin 204. A pair of springs 205, positioned in recesses in the head and arm, bias the head 202 in an adjusted position determined by the setting of a stop screw 206 relative to stop 207. The springs will permit some tilting of the head, but of a very limited extent.

The sealing head is composed of a slotted metal holder 208 within which a metal bar 209 is positioned. The bar 209 supports a foam material 210 such as fairly dense foam rubber which has a contoured face that parallels the side wall and heel of the bottle to be labeled. Covering the contoured face of the foam material is an electrical strip heater element 211.

The element 211 is an electrical strip that is flexible and can flex to some extent to accommodate the force of being pressed against the side of a bottle with the overlapped ends of a foam label interposed. One example of the heater strip is termed a silicone rubber/Fiberglass insulated wire element heater sold by Electro-Flex Heat, Inc., of Bloomfield, Conn., U.S.A. The heater comes in strip form and may be cemented to the front of the foam rubber mounting pad 210.

One very successful strip heater element configuration, which has proved capable of working in a temperature range of −80° F. to 455° F., is that shown in the sectional view FIG. 12. The electrical heating element 211 is actually composed of a 0.5–2 mil. strip 235 surrounded and imbedded in a silicone rubber 236 that is vulcanized. This vulcanized silicone rubber strip 236 with the imbedded heater element 235 is fastened or adhered to the support 210. The other side of the strip 236 is provided with an adhesive layer 237 to which a berylium metal heat sink 238 is adhered. The outside surface of the berylium strip 238 is covered by a layer of fused Teflon 239. The composite strip 211 has the advantage of an extended life and, by having a Teflon outer surface, the wear characteristics is improved. The necessity of a heat sink 238 was determined when other systems were tried and the heat conductivity from the heater element to the outer surface was found to be inconsistent.

The heater element 235 will have a precise heat output due to its precision gauging. The heater elements with silicone rubber insulation are produced by Minco Products, Inc., of Minneapolis, Minn., under the trademark "Thermofoil" heaters. The mounting of the heater strip with a metallic heat sink between the heater and the outer Teflon surface has served to provide a more uniform surface temperature for the heat seal unit when in operation.

Additionally, it is advantageous to use a heat conductive silicone for mounting the metal strip heater and a vulcanizing system for attaching the pad 236 to the heat sink 238.

With the heat sink system, it is possible to use a hot air impingement for providing the heat to the heat sink rather than the electrical strip element. The alternative system is an advantage in the event of failure of one or more of the electrical strip heaters 235.

The heater element is pressed against the overlap seam of the label and will heat seal the edges of the labels to each other to form a tight seam. The high temperature silicone rubber will give to some extent so that the force of the heater against the label will be fairly uniform and therefore promote the proper thermal transmission to effect a complete seal. The heater strip has a pair of leads 212 connected thereto and the leads are connected through a slip ring connection to a stationary source of power.

The period of time that the heater is held against the seam is adjustable, automatically, depending upon the speed at which the labels are being applied to the bottles. The temperature of the electrical heater strip is in the range of 450° F. (400°–480° F.) and, since the determinant of a good seal is a time/temperature factor related to the thermal transmission of the heat to the label, it is necessary that the label not be overheated or it may burn; and if not adequately heated, a satisfactory seal will not be formed. In order to control the time that the heat seal strip is held in contact with the label, the motor 191 is tripped in its forward or extending movement by a control valve 213 carried by a bracket 214 mounted to the vertical side of the bar 166. The valve 213 is supplied with air under pressure through a line 215 connected to a source (not shown). As the sealing bar carriage 95 moves from position "a" to position "b" in FIG. 1, a stationary cam 216 trips a lower actuator 217 of the valve 213 to connect air through a line 218 to the end of the motor 191 to cause the piston 192 and arm 200 to extend and bring the heater strip 211 into contact with the overlapped label ends or edges. The valve 213, once it is tripped by the cam 216, will remain in the same position until an upper actuator 219 is tripped. The actuator 219 will connect the source of air to a line 220 to cause the motor to retract its piston rod and the heater strip. The actuator 219 is tripped by a cam 221 that is mounted to an arm 222 that is driven by a follower 223 of a speed screw 224. The speed screw 224 is positioned in a horizontal housing 225 that extends from a gear box 226. The follower 223 is guided in a linear path by a roller 227 that is riding in elongated guide bar 228. The guide bar 228 is mounted in a fixed position above a hollow support beam 229 that is mounted on the plate 169. The gear box 226 is coupled to an electrical tachometer motor 230 which is electrically connected to a tachometer generator (not shown) that is driven from the main drive motor M.

Thus it can be seen that the heat seal strip will stay in contact with the label until the actuator 219 is tripped by the cam 221. The cam 221 will be moved along the length of the path of travel of the sealing bar carriage to a greater or lesser extent, depending upon the speed of the motor M. When the labeling system of the invention is operating with its 16 heads functioning and labeling 500 bottles per minute, the heat seal bar or strip will be traveling at a fairly rapid rate and the cam 221 will be positioned by the motor 230 near the end of the straight run of the carriages so that the heat seal may be made, but if the machine is slowed down for any reason, the heat seal bar will have to be retracted before it reaches the end of the straight run because it will have been in contact with the label for too long a time and could burn the label. When running slower, the cam 221 will be automatically moved and positioned to the left, as viewed in FIG. 1, so that the heat seal strip will be retracted from the bottle sooner.

The system illustrated in the drawings is one where 16 carriages or heads 95 are moved continuously in a generally oval path with one side of the path being parallel to one side of the oval path that the vacuum pad carriages 101 will be driven. As best seen in FIG. 1, the two adjacent paths are not coextensive, but are of essentially the same length. The path of the vacuum pad carriages 101 starts its straight section parallel to the conveyor 57 before the straight section of the path of the carriages 95. This offset of the two parallel paths is to permit the labels to be assembled to the bottles before the sealing head motor 191 is actuated to move the sealing head into contact with the overlap seam. The head of course remains in contact with the bottle for a period of time determined by the speed of movement of the bottles. This adjustable period of holding the sealing head in contact with the label is controlled by a motor driven cam that has its position changed according to the time the label is contacted by the heat seal bar. Alternatively, the motor 191 could be cycled with a predetermined time period, although changes of speed during movement would not be specifically and automatically adjusted as with the present system, but would be effective to keep the sealing bar on the label for a finite period only.

Having described the best mode contemplated for carrying out the labeling system of the invention, it is understood that modifications may be resorted to which will be within the scope of the appended claims.

What is claimed:

1. The method of applying wrap-around labels of thermoplastic sheet material to containers, comprising the steps of moving a continuous series of containers in a generally upright attitude on a continuously moving horizontal conveyor, spacing containers at precise intervals at the incoming end of said conveyor, engaging individual labels with a series of vacuum transport heads, moving said transport heads in an endless horizontal path having a portion of said path moving parallel to the movement of said conveyor at intervals corresponding to the spacing of the containers on the conveyor, simultaneously moving the ends of a label outwardly at each side of a container while retaining the vertical center of the label engaged with the transport head, continuing the outward movement and timing the movement of the ends of the label so that the label surrounds the container, pushing the ends of the label toward each other to overlap the ends thereof in a vertical line which is diametrically opposite the vertical center of the label at the opposite side of the container, engaging the overlapping vertical line of said label with a heat-seal member, maintaining said heat-seal member in engagement with said label with a sufficient force and at a sufficient temperature to effect a complete heat-sealing of the ends of the label to each other, and disengaging the heat-seal bar from the label to permit the container with surrounding label to proceed on the conveyor.

2. The method of claim 1 wherein the step of moving the ends of the labels about a container includes moving a pair of label engaging arms outwardly from in back of a label toward a container positioned thereinfront, and moving the ends of the arms toward each other to cause the label to overlap.

3. The method of claim 1 further including moving a plurality of heat-seal member carriages in an endless path with a portion of the path moving in parallel to the movement of the label transport heads in opposition thereto with an intervening container.

4. The method of claim 1 wherein said transport head has a plurality of vacuum ports in its face and vacuum is applied to all of the ports in the head until the arms engage the ends of the label, at which time the vacuum is released, except for a vertical line of ports at the center of said head.

5. The method of claim 1 wherein the step of heat-sealing the overlapped ends of the label includes engaging the overlap ends with a vertical heated member.

6. The method of claim 1 further including engaging the tops of the containers as they enter the position between the transport head and the heat-seal member to stabilize the containers and bias the containers against the conveyor.

7. Apparatus for applying wrap-around foam labels to upright containers moving in a linear path on a horizontal conveyor, comprising means for spacing the containers at specific intervals on the conveyor, a plurality of label transfer heads, means connecting said plural transfer heads in an elongated, endless side-by-side series that runs in an oval path with one portion of the path running parallel to the spaced containers on said conveyor, a label transfer station positioned adjacent the path of travel of said transfer heads in advance of said parallel path for supplying individual labels to said transfer heads, said heads having vacuum supplied thereto through a plurality of passages that open through the surface thereof for securing the label to the surface of the head, means driving said heads past said transfer station in sequence and applying vacuum to said heads at a plurality of ports on the heads, a vertical line of ports substantially on the vertical center line of each head, a pair of label engaging arms carried by each head, said label engaging arms being mounted on said head for movement from in back of said label on either side of said vertical line of ports for bending a foam label carried thereby into a semi-circular attitude, means for moving said heads in succession from said label transfer station to a position where the bent label is moved into surrounding relationship with a spaced container on said horizontal conveyor, said arms moving the ends of said label into overlapping relationship on the side of the container opposite from the vertical line of vacuum ports, a series of heat-seal bars, means mounting said bars at spaced intervals on an endless chain in a path that aligns with the movement of containers on said linear conveyor, means on said bar mounting means for moving each bar into engagement with the overlapped label carried by the label transfer head and surrounding the container, said bar applying heat to a vertical overlap line of said label and applying a force against the interposed container and label against the transfer head, and means for moving said heat-seal bar and label transfer head with interposed label and container in a straight line for a period sufficient to heat seal the overlapping ends of the labels.

8. The apparatus of claim 7 wherein the heat-seal bar is formed with a contour that essentially matches an external heel, shoulder and side wall of the container.

9. The apparatus of claim 8 wherein said heat-sealing bars comprise a composite, flexible strip adhered to front face of a reciprocable support member, said strip including a heat sink member.

10. The apparatus of claim 7 wherein said heat-seal bar comprises a flexible strip including an electrical resistance element encapsulated in a silicone rubber, means attaching said encapsulated element to a reciprocable support member, a heat-sink member overlying said resistance element and wear resistant coating adhered to the outside of said heat-sink member.

11. The apparatus of claim 7 further including means for engaging the tops of the containers for biasing the bottoms of the containers against the conveyor.

12. Apparatus for applying foam plastic labels to a container, comprising a horizontal moving conveyor, means at one side of said conveyor for spacing a plurality of containers supported on said conveyor, a plurality of label supporting heads, means for supporting and moving said heads in a continuous path at spaced intervals corresponding to the spacing of containers, said continuous path having a portion that parallels the conveyor at one side thereof, arm means carried by said heads for engaging the ends of a label supported by said head and moving the ends of the label into surrounding and overlapping relationship with respect to a container, a plurality of heat-sealing bars, means for supporting said bars for horizontal movement in an endless path where a portion of said path is parallel to the conveyor movement, said bars being supported at spaced intervals corresponding to the spacing of the containers on the conveyor, and means carried by said bar supports for reciprocating said bars into engagement with the overlapping ends of a label, maintaining the engagement for a finite period of time and retracting the bar when the label ends have been sealed.

13. The apparatus of claim 12, including an endless stationary cam track paralleling the movement of said heads, and cam follower means connected to said arm means for moving said arm means.

14. The apparatus of claim 12 wherein said heat-sealing bars comprise a composite, flexible strip adhered to a front face of a reciprocable support member, said strip including a heat-sink member.

15. The apparatus of claim 12 wherein said heat-seal bar comprises a flexible strip including an electrical resistance element encapsulated in a silicone rubber, means attaching said encapsulated element to a reciprocable support member, a heat-sink member overlying said resistance element and wear-resistant coating adhered to the outside of said heat-sink member.

* * * * *